US005361813A

United States Patent [19]

Lay

[11] Patent Number: 5,361,813

[45] Date of Patent: Nov. 8, 1994

[54] WOOD PATCH CUTTING METHOD AND APPARATUS

[75] Inventor: James D. Lay, Eugene, Oreg.

[73] Assignee: Oregon Industrial Machine & Manufacturing, Inc., Eugene, Oreg.

[21] Appl. No.: 12,298

[22] Filed: Feb. 1, 1993

[51] Int. Cl.[5] ..... B27C 5/00; B27F 1/08

[52] U.S. Cl. ..... 144/363; 144/2 M; 144/134 R; 144/2 R; 144/218; 144/240; 144/242 R; 144/242 C; 144/242 K; 144/329; 144/332; 269/274; 269/282; 269/283

[58] Field of Search ..... 144/2 R, 2 M, 134 R, 144/136 R, 137, 218, 221, 235, 236, 240, 242 R, 242 C, 242 K, 329, 330, 332, 363; 269/274, 282, 283

[56] References Cited

U.S. PATENT DOCUMENTS

| | | | |
|---|---|---|---|
| 1,014,794 | 1/1912 | Weirbach | 144/231 |
| 1,630,173 | 5/1927 | Dumont | 144/134 R |
| 1,796,185 | 3/1931 | Beerworth | 144/2 M |
| 1,816,853 | 8/1931 | Jayne | 144/2 M |
| 2,355,865 | 8/1944 | Hofbauer | 144/218 |
| 2,470,229 | 5/1949 | Anderson | 144/2 M |
| 2,652,864 | 9/1953 | Angvers | 144/2 M |
| 2,771,106 | 11/1956 | Sigle | 144/134 R |
| 2,985,203 | 5/1961 | Wirth | 144/2 M |
| 3,946,777 | 3/1976 | Heimbrand | 144/218 |
| 4,064,920 | 12/1977 | Piche | 144/218 |
| 4,949,767 | 8/1990 | Murphy | 144/369 |

FOREIGN PATENT DOCUMENTS

| | | | |
|---|---|---|---|
| 18392 | 4/1957 | France | 144/221 |

*Primary Examiner*—W. Donald Bray
*Attorney, Agent, or Firm*—Klarquist Sparkman Campbell Whinston & Leigh

[57] ABSTRACT

An apparatus and method for making wood patches wherein an elongate piece of wood patch stock is inserted longitudinally into an end of the apparatus. The wood patch stock is incrementally moved toward cutting blades by a clamp mounted on a carriage. A channel guides the elongate into a cutter clamp, which immobilizes the elongate patch stock for cutting by the cutter blades. The cutter blades pass transversely across the clamped elongate patch stock to cut a wood patch. The cut wood patch is blown into an exit chute, and the process is repeated.

29 Claims, 7 Drawing Sheets

WOOD PATCH CUTTING METHOD AND APPARATUS

TECHNICAL FIELD

The present invention relates to a method and apparatus for cutting wood patches that are inserted into correspondingly sized defect holes in wood components, such as components of doors and window frames.

BACKGROUND OF THE INVENTION

Wood patches are known for repairing defects, such as pitch pockets, in wooden components for doors and the like. To ensure a tight patch fit, the defect is commonly removed by routing to yield a slot in the wood panel somewhat smaller than the dimensions of the wood patch. Elongate patches with triangular cross-sections having a radius of curvature on one surface have been found to grip particularly well into correspondingly shaped slots. The wood patch is basted with adhesive, and pressed into the defect slot with the grain of the wood patch oriented with the grain of the wood panel. Thereafter, the patch area is sanded to yield a patch that closely blends with the surrounding wood of the door component.

In today's lumber industry, the increasing scarcity of high-quality old growth timber has resulted in an increased need for wood patch utilization. This arises because wood defects, such as pitch pockets, occur with greater frequency in the lumber available today. This increase in defects occurs even in lumber for use in high-quality wood products, particularly those which are stained rather than covered by painting.

Accordingly, it is important to produce wooden patches efficiently and cheaply. U.S. Pat. No. 4,949,767 to Murphy discloses an apparatus for manufacturing wood patches. The Murphy apparatus uses a rectangular piece of wood stock secured by a clamp, from which wood patches are cut by a combination of two cutters. The lower surfaces of the patch are cut by a double router bit that follows a sinusoidal cam surface extending longitudinally along the piece of wood stock. The double router bit has a vertical and an angled cutting edge that produce a pointed protrusion on the wood stock along the sinusoidal path. The patch cutting is completed by a blade which cuts the stock longitudinally to sever the protrusions at the bottom of the sinusoids. The resulting patches are somewhat "boat shaped" with curved or radiused ends and a triangular cross-section. With this approach, there is a significant amount of waste of wood patch stock material.

The length of the patches produced by the Murphy apparatus is varied by substituting cams with different periodic geometry. To produce wood patches of precise dimensions, the periodic geometry on the cams must be precisely machined. Since the Murphy cam surfaces are of a substantial length, having as many as 10 or more repetitions of the periodic geometry, the machining of the cam may be expensive.

Another wood patch cutting device uses a manually-operated generally half-moon shaped cutter. The half-moon cutter is moved vertically downwardly in a stamping action through a piece of wood patch stock resting on a cutting block of ultra high molecular weight plastic. The blades shear the wood to yield a wood patch. Such blades tend to become dulled after a few dozen cycles, causing the grain of the wood patch to be crushed.

A need exists for an improved method and apparatus for forming wood patches which overcomes these and other disadvantages of the prior art.

SUMMARY OF THE INVENTION

A secondary object of the present invention is to provide an apparatus and method for making wood patches which continuously cuts wood patches as the apparatus is fed wood patch stock.

Another objective of this invention is to provide an apparatus and method for making wood patches that minimizes the waste of wood patch stock.

Yet another objective of this invention is to provide an apparatus and method for making wood patches which is relatively easy to adjust to produce wood patches of difference lengths.

A further objective of this invention is to provide an apparatus for making wood patches which has a high wood patch production rate.

An apparatus for forming wood patches in accordance with one embodiment of the present invention has an apparatus frame with a feeder for advancing wood patch stock longitudinally into the path traversed by a rotating cutter mounted to a traveling carriage. The wood patch stock is oriented by an ingress guide about its longitudinal axis for presentation to the cutter. The cutter moves transversely across the wood patch stock to produce a wood patch.

Elongate pieces of wood patch stock are fed into the feeder where they are clamped by a feed clamp and moved on a sled down a track toward the cutter. The patch stock is fed from the feed clamp into a channel with a flared access. Adjacent the flared access is a roller portion with a series of resiliently supported rollers which bias the patch stock against the channel as the wood patch stock is advanced to an adjacent cutter clamp. The cutter clamp closes upon and immobilizes the fed patch stock while blades of the cutter pass transversely through the patch stock to form a wood patch. The wood patch is then blown by a jet of pressurized air through an exit chute and into a wood patch bin.

The cutter has blades which travel through a path which may be generally described as a cylinder with enlarged ends. As a result, the wood patches are generally "boat shaped" with radiused ends formed by the end portions of the cutter. The length of the patch is determined by the length of the cylinder defined by the cutter, which may be varied by elongating the cutter, for example by including a spacer between cutting elements of the cutter. Such cutter elements may comprise a cutter body section, which may be conical in shape, with plural cutting blades projecting from the body. These cutting blades preferably have arcuate cutting edges and are helically disposed on the body section.

To expose the patch stock elongate for cutting by the cutter blades, the cutter clamp has a face that is contoured to correspond to the contour of the rotating cutter bodies as the cutter moves through a cutting stroke. The fed patch stock is exposed within the contours on the cutter clamp face so that the cutter blades move through the elongate wood patch stock to form the wood patch with arcuate end surfaces.

Plural limit switches may be used to control the patch cutting cycle. For example, a first limit switch may be engaged by the carriage as the cutter reaches one end (i.e. the top) of a cutting stroke. The first limit switch causes the feed clamp to engage the wood patch stock and the sled to travel from an initial position along a track to a second position at which a second limit switch is engaged. The wood patch stock in this case is advanced longitudinally with the sled. The second limit switch causes the cutter clamp to engage the wood patch stock before the cutter begins cutting the wood patch stock. At the opposite end (e.g. the bottom) of the cutting stroke, a third, forth, and fifth limit switches may be simultaneously engaged. The third limit switch causes the cutter clamp to release, the fourth limit switch causes pressurized air to move said patch into an exit chute, and the fifth limit switch causes the feed clamp to open, and the sled to return to the initial position. The cycle is then repeated.

The present invention relates to the above described objects and features individually as well as collectively. These and other features, objects, and advantages of the present invention will become apparent with reference to the following description and drawings.

DETAILED DESCRIPTION OF THE ILLUSTRATED EMBODIMENT

Figure 1:
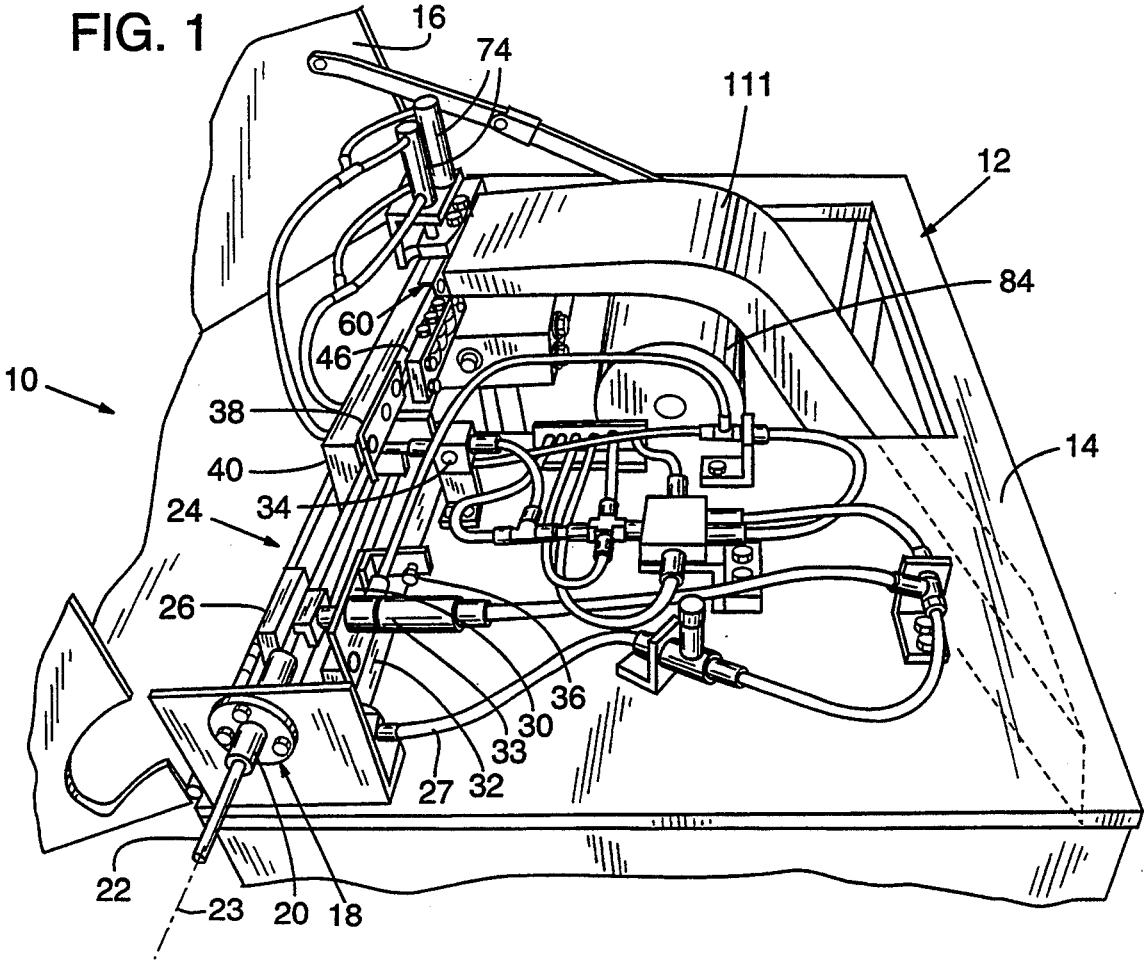
FIG. 1 is a perspective cut-away view of an apparatus for making wood patches in accordance with one preferred embodiment of the present invention.

As shown generally in FIG. 1, an apparatus 10 for cutting wood patches in accordance with one preferred embodiment of the present invention has a rectangular apparatus frame in the shape of a rectangular block 12 (the lower frame portion being cut-away in FIG. 1). The top 14 of the frame 12 is covered by a removable cover 16. In FIG. 1, one form of an ingress guide 18 for elongate wood patch stock 22 is shown located adjacent the rear left-hand corner of the top 14 of the apparatus frame.

Figure 2:
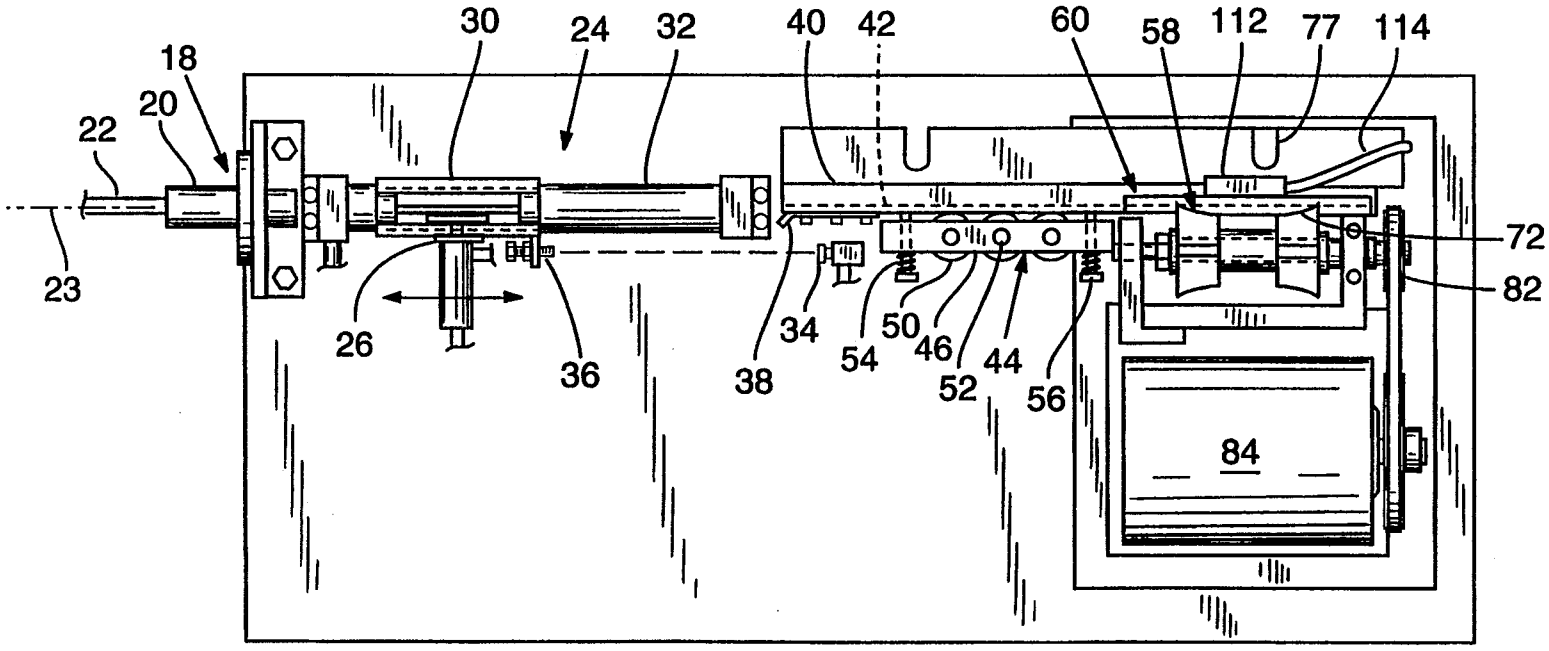
FIG. 2 is a top plan view of a portion of the apparatus of FIG. 1, with selected portions of the apparatus removed for illustration purposes.

Elongate patch stock 22 is fed longitudinally along its longitudinal axis 23 into the ingress 18. A feeder 24 receives the wood patch stock and moves it into the path of a cutter 58 (FIG. 2). The illustrated feeder 24 more specifically moves the patch stock into a cutter clamp 60 which holds the stock for cutting by a rotating cutter 58. The cutter is moved transversely across the clamped wood patch stock 22 to cut an individual wood patch.

Figure 8:
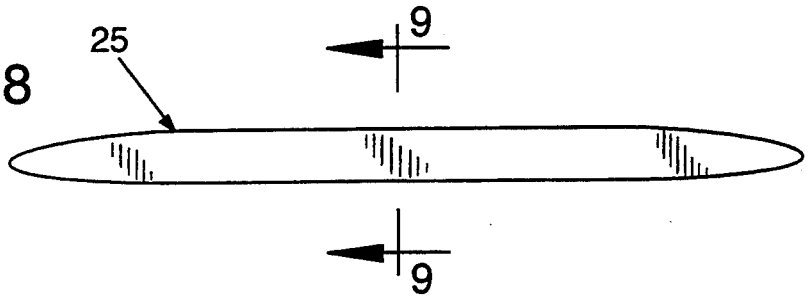
FIGS. 8 and 9 show one form of a wood patch produced by the FIG. 1 embodiment in respective side elevational and cross-sectional views.
Figure 9:
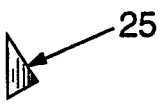

This embodiment of the invention contemplates an apparatus for making a wood patch 25 (see FIGS. 8 and 9) which has a shape which depends in part upon the dimensions of the wood patch stock and the configuration of the cutter. With the embodiment of FIG. 1, the patch has a longitudinal middle portion arcuate or radiused ends and a right-triangular cross-section (because the patch stock was of this cross-section). On each side of the middle portion of the patch, the patch surface corresponding to the hypotenuse of the triangular cross-section of the wood patch stock is cut back in all arcuate contour. The ingress 18 orients the wood patch stock about its axis 23 for cutting in this manner. The length of the patch and radius of the patch ends depends upon the configuration of the cutter 58 and may be modified, such as explained below.

To produce that wood patch described above, the illustrated embodiment uses patch stock elongates 22 of a uniform cross-section. The elongate cross-section is identical to the cross-section of the uncut longitudinal middle portion of a wood patch. Such patch stock 22 is manufactured through routing processes known in the prior art in the manufacture of woodwork, moldings, and the like. These processes minimize the waste of material and otherwise wasted scrap material may be used for the wood patch stock. The patch stock is optimally made from the same type and grain as the wood in the door or other wood component to be patched. The length of the patch stock elongate 22 varies, but it is commonly around 8 feet in length.

While the illustrated embodiment produces a wood patch with the above-described middle of constant cross-section, it is understood that this invention may be used to produce wood patches of other geometries. For instance, the wood patch may have ends that taper off in planar surfaces. Alternatively, the wood patch may be without a middle portion of constant cross-section.

The illustrated ingress 18 is optional and has a guide tube 20 mounted to the frame 12 by a bracket (FIG. 1) and housing a guide which is operable to orient the patch stock 22 about its axis 23 for processing into patches. More specifically, the illustrated guide comprises an opening to the guide tube with a triangular cross-section corresponding to the cross-section of the patch stock 22. The guide opening is positioned in the preferred case to orient the right angle of the triangular patch stock 22 cross-section toward the rear of the frame 12 and to orient the hypotenuse of the stock cross-section vertically and toward the front of the frame. Most preferably, the upper end of the forward face of the stock is tilted rearwardly about eight and one-half degrees out of vertical as this has resulted in improved cutting of the patches. The elongated nature of the guide tube 20 also orients the axis of the wood patch stock in proper alignment with the apparatus.

It should be noted that, if used at all, a variety of alternative ingress guides could also be used. For instance, a simple wedge or a pointed notch in the ingress could provide for proper orientation. Thus, any ingress guide which requires a particular angular orientation of the patch stock would be suitable.

The patch stock passes through the ingress 18 and enters the feeder 24. The feeder is operable to incrementally advance or move the patch stock 22 toward the cutter 58. The illustrated feeder 24 includes a feed clamp 26 which receives the wood patch stock. The feed clamp 26 is mounted for motion to carry the patch stock, such as on a sled 30, which slides along a track 32. The track 32 extends along the longitudinal axis, from a home position adjacent the ingress guide to a second position. The feed clamp 26 is activated to close upon the elongate 22, such as in response to a signal from a first limit switch 116 as explained below. When the sled reaches the second position on the track 32, a second limit switch is engaged by an adjustable limit screw 36 which is threaded through a bracket attached to the sled 30, for purposes explained below.

In the preferred embodiment, the feed clamp 26 is actuated by an pneumatic cylinder 33. The clamp 26 has clamping faces contoured to conform to the triangular cross-section of the patch stock 22, in order to secure the wood patch stock while the sled 30 is moving the patch stock along the track 32. In the preferred embodiment, the sled is actuated by a rodless pneumatic cylinder with a 6-inch stroke, as most patches are of the length or shorter. The stroke may be lengthened as required.

All of the pneumatic devices referred to in the illustrated embodiment, are operated from pneumatic lines 27, for example pressurized to 65 psi. The pressurized air is supplied by a compressor (not shown) positioned outside of the frame 12.

While the illustrated embodiment relies on pneumatic clamps and a pneumatic sled cylinder, it should be apparent that other clamp and sled actuating devices may work equally as well. For instance, the clamps and sled may be actuated by screw-drives, electrical solenoids, or other actuation devices. In the case of electro-magnetic devices, the pneumatic lines 27 of the illustrated embodiment would be replaced with electrical circuitry. In addition, other wood stock conveyors may also be used, such as motor/belt or motor/chain conveyors, or friction conveying mechanisms. Any actuation devices with operation speeds adequate for apparatus operation at typical patch production cycle speeds, such as thirty to sixty or more patches per minute, may be used.

As the sled and sled-mounted feed clamp 26 move, the patch stock elongate 22 is moved along the longitudinal axis 23 into a channel 42 (FIG. 2), which guides the elongate into a cutter clamp 60. An elongate rectangular channel block 40 is provided with a notched channel extending along the channel block front face, which is shaped to receive the right-angle of the cross-section of patch stock 22. The channel is of a depth so that the patch stock protrudes slightly from the channel 42.

The channel block 40 is mounted to the frame top 14 so that the channel 42 is coaxial with the longitudinal axis 23. The channel block 40 has a flared entry 38 adjacent the second position, which receives the elongate wood patch stock being advanced by the sled-mounted feed clamp 26, and guides the wood patch stock into the channel 42. The flared entry 38 comprises a vertically supported rectangular plate which extends longitudinally across the face of the channel. The patch stock receiving end of the flared entry plate 38 is bent to project radially outwardly from the channel block 40, in order to capture warped or otherwise misaligned advancing patch stock pieces 22.

Once captured, the patch stock elongate 22 passes between the channel 42 and an overlying optional biasing mechanism, such as a roller portion 44. The illustrated roller portion comprises a rectangular roller frame 46. The roller frame has a roller receiving slot within which plural, in this case three, resilient rollers 50 are positioned, with each roller rotating about an axle 52 perpendicularly disposed to the longitudinal axis 23.

The roller frame 46 is mounted longitudinally adjacent the channel block 40, so that the rollers 50 straddle the channel 42. Thus, the rollers are oriented to rotate to allow the elongate to move longitudinally between the channel 42 and the rollers 50.

Figure 4:
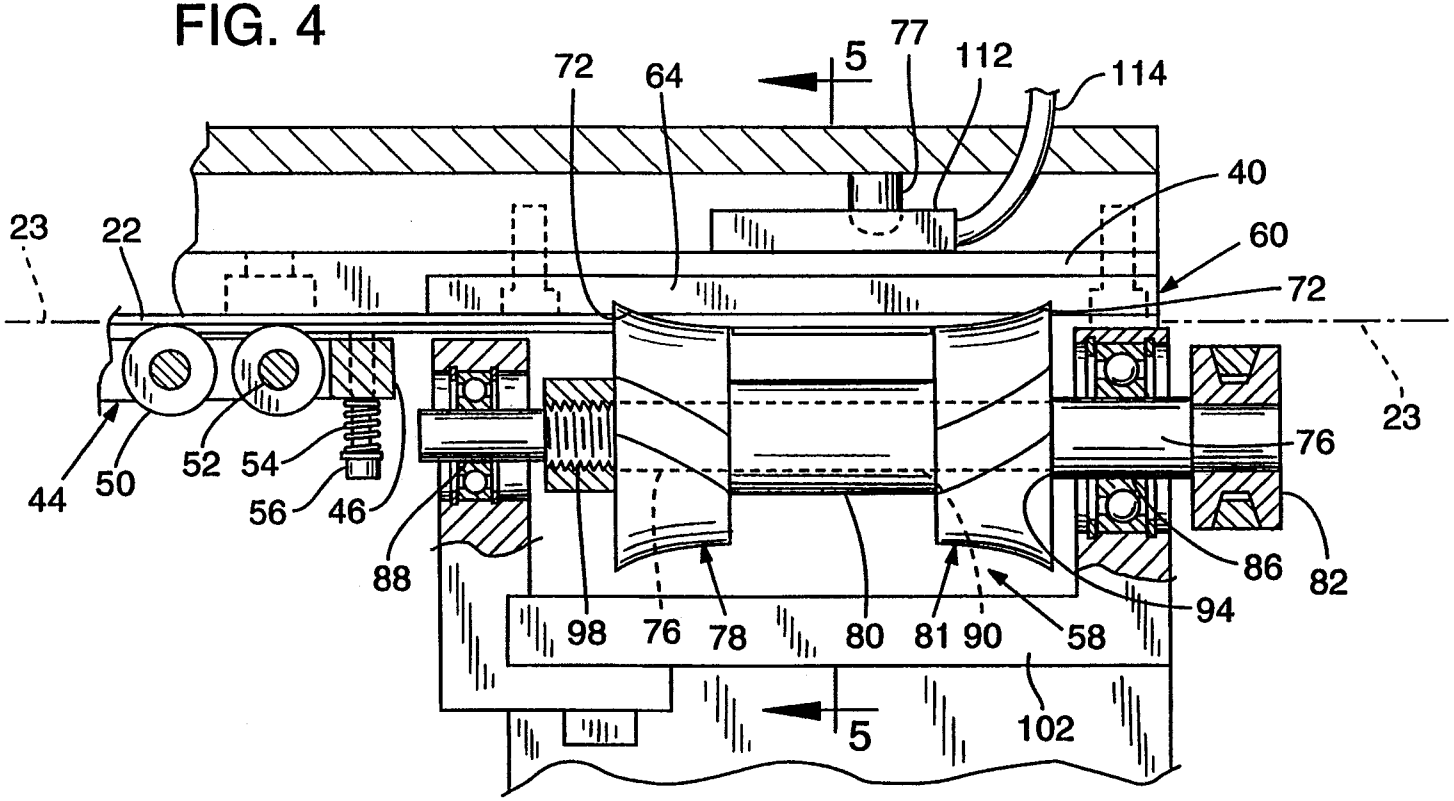
FIG. 4 is a top plan cutaway view of the cutter portion of the FIG. 1 embodiment of the present invention.

The roller frame 46 is resiliently mounted to the frame and biases the rollers 50 against the channel block 40 on either side of the channel 42 (see FIGS. 2 and 4). The resilient mounting is achieved by roller frame screws 56 which slidably extend through holes in the roller frame 46, and are fastened into the channel block 40. Pre-compressed biasing springs 54 are located between the head of the frame screws 56 and the roller frame 46. Because the patch elongate extends above the channel 42, the rollers 50 are urged against the stock elongate 22, thereby providing a resistive biasing force on the patch stock 22. This biasing force is desirable in that it stabilizes the patch stock elongate, particularly when the feed and cutter clamps 26, 60 are disengaged, while allowing the smooth passage of the patch stock elongate 22 through the channel 42.

Figure 5:
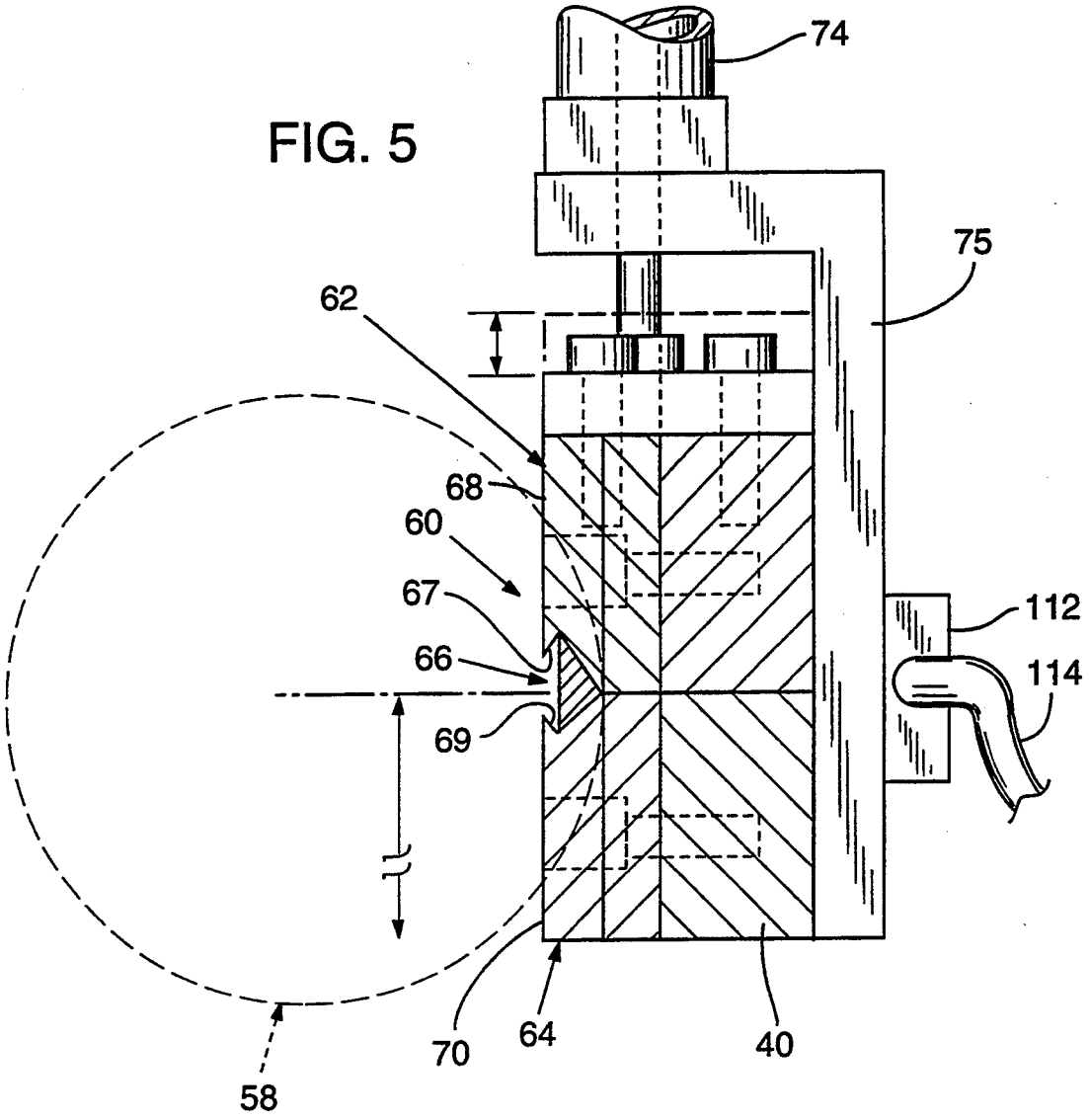
FIG. 5 is a vertical sectional side view of a cutter clamp of the FIG. 1 embodiment taken along line 5—5 of FIG. 4.

The cutter clamp 60 (FIGS. 4 and 5) is comprised of an upper clamp portion 62 and a lower clamp portion 64. The upper and lower clamp portions each have a respective face 68, 70 which faces toward the cutter 58. The lower clamp portion 64 is mounted to the channel block 40 so that the longitudinal axis 23 of the patch elongate 22 passes through a first longitudinal groove 66 defined between the lower front corner of clamp portion 62 and the upper front corner of clamp portion 64. Projecting lip portions 67, 69 of the respective clamp portions 62, 64 retain the wood patch stock 22 in the groove 66 when the clamp portions 62, 64 are closed together as shown in FIG. 5. Thus, when the cutter clamp 60 is closed upon the wood patch stock 22, the longitudinal groove 66, and lips 67, 69 assist in immobilizing the patch stock 22 for cutting by the cutter 58, to provide a uniform arcuate cut longitudinally along both ends of the wood patch.

The illustrated upper clamp portion 62 has a height of 1.00 inch and a width of 0.562 inch. The portion of groove 66, defined by the upper clamp portion, is notched to receive the smaller acute angle of the patch stock right-triangular cross-section. The notch is 0.200 inch deep with the top of the notch being recessed 0.080 inch from the front face 68 of the clamp. The lower clamp 64 portion has a vertical dimension of 1.000 inch, and a thickness of 0.562 inch. The portion of the longitudinal groove 66 in the lower clamp portion 64 is shaped to receive the larger acute angle of the patch stock triangular cross-section. The notch in clamp portion 64 is 0.062 inch deep with the bottom of the notch being recessed 0.040 inch from the lower clamp face 70.

The recess defined by the notches of the upper and lower clamp portions are offset different distances from the respective clamp faces 68, 70 (0.040 inch on the upper versus 0.080 inch on the lower). As a result, the elongate surface corresponding to the hypotenuse of the right-triangular cross-section of the wood patch stock is slightly tilted from the vertical. This offset has been observed to facilitate the production of a smooth arcuate cut longitudinally at the ends of the wood patch. Such an even arcuate patch surface is believed to provide an even grip within wood defect slots. It is to be understood, however, that clamps with other groove geometries may be used.

As will be described below with reference to FIGS. 3A, 3B, 3C, and 4, the illustrated cutter 58 has blades 100 which cut through the patch stock 22. The cutter clamp faces 68, 70 have vertical grooves 72 (FIG. 4), described more fully below, which expose to the blades 100 the portions of the elongate 22 which are to be cut.

The activation of the second limit switch 34 (FIG. 2) by the sled 30, as described above, results in a signal which causes a valve to pneumatically actuate the cutter clamp 60 to close and engage the patch stock elongate 22. The actuation is carried out by two pneumatic cylinders 74 (one being shown in FIGS. 5 and 6) which operate to move the clamp upper portion 62 downwardly to engage the clamp lower portion 64. The cylinders 74 are supported by an L-shaped bracket 75 extending over the cutter clamp 60. The illustrated embodiment utilizes two pneumatic cylinder actuators to provide uniform clamping pressure along the cutter clamp. It is appreciated, however, that a single clamp actuator will also suffice. Hydraulic or other cutter clamp actuators may also be used. Equivalently, the lower cutter clamp portion 64 may be moved with the upper clamp element 62 stationary, or both may be moved to close together. However, by fixing the lower clamp element 64, alignment of the cutter clamp with incoming wood stock is easier to maintain.

The illustrated cutter 58 will now be described. The cutter 58 is supported by a carriage frame 102 which is movably mounted to the frame 12 for carrying the cutter along a path transversely across wood patch stock 22 during a cutting stroke. The carriage moves the cutter 58 in a direction such that the axis of rotation of the cutter is offset from a line which is perpendicular to the longitudinal axis 23. More specifically, the cutter preferably rotates about an axis which is at no more than an acute angle with respect to the longitudinal axis 23 and most preferably which is parallel to the axis 23. In the illustrated embodiment, the cutter 58 is rotated about a horizontal axis, the wood patch stock 22 is advanced horizontally, and the carriage is moved vertically.

Figure 3A:
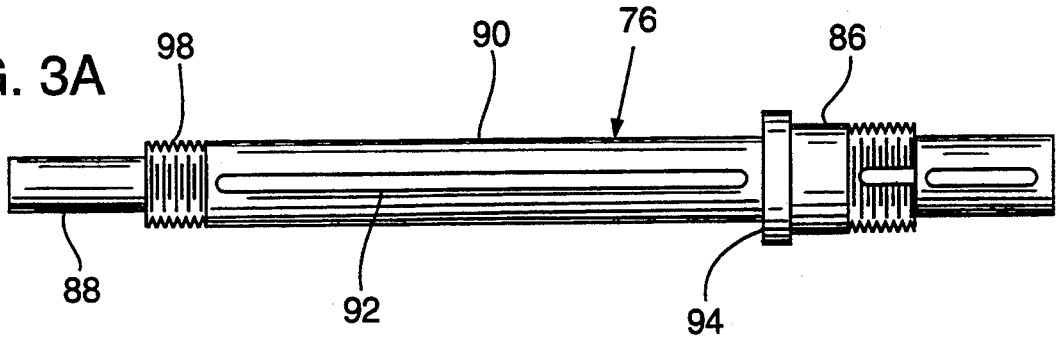
FIG. 3A is a side elevational view of a cutter spindle used in the FIG. 1 embodiment.
Figure 3B:
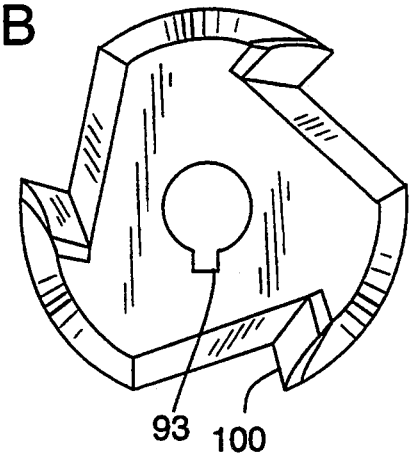
FIG. 3B is an end view of one form of a cutter body used in the embodiment of FIG. 1.
Figure 3C:
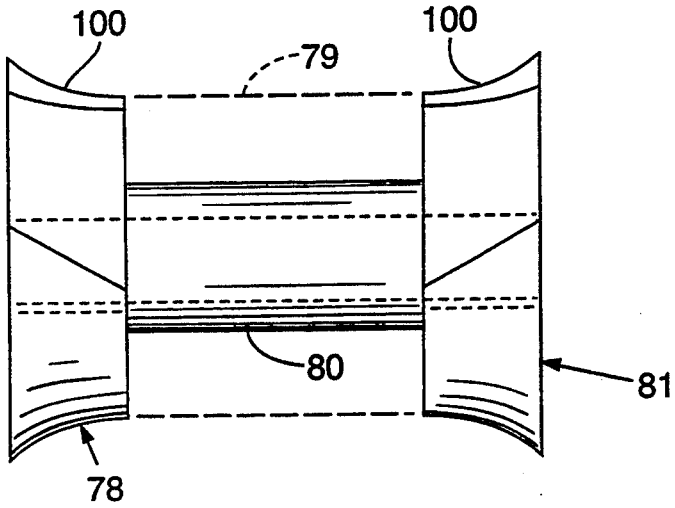
FIG. 3C is a side elevational view of a pair of cutter bodies used in the embodiment of FIG. 1 shown spaced apart as they may be positioned on the spindle of FIG. 3A and with the cylindrical path defined by the rotation of these cutting bodies indicated in dashed lines.
Figure 6:
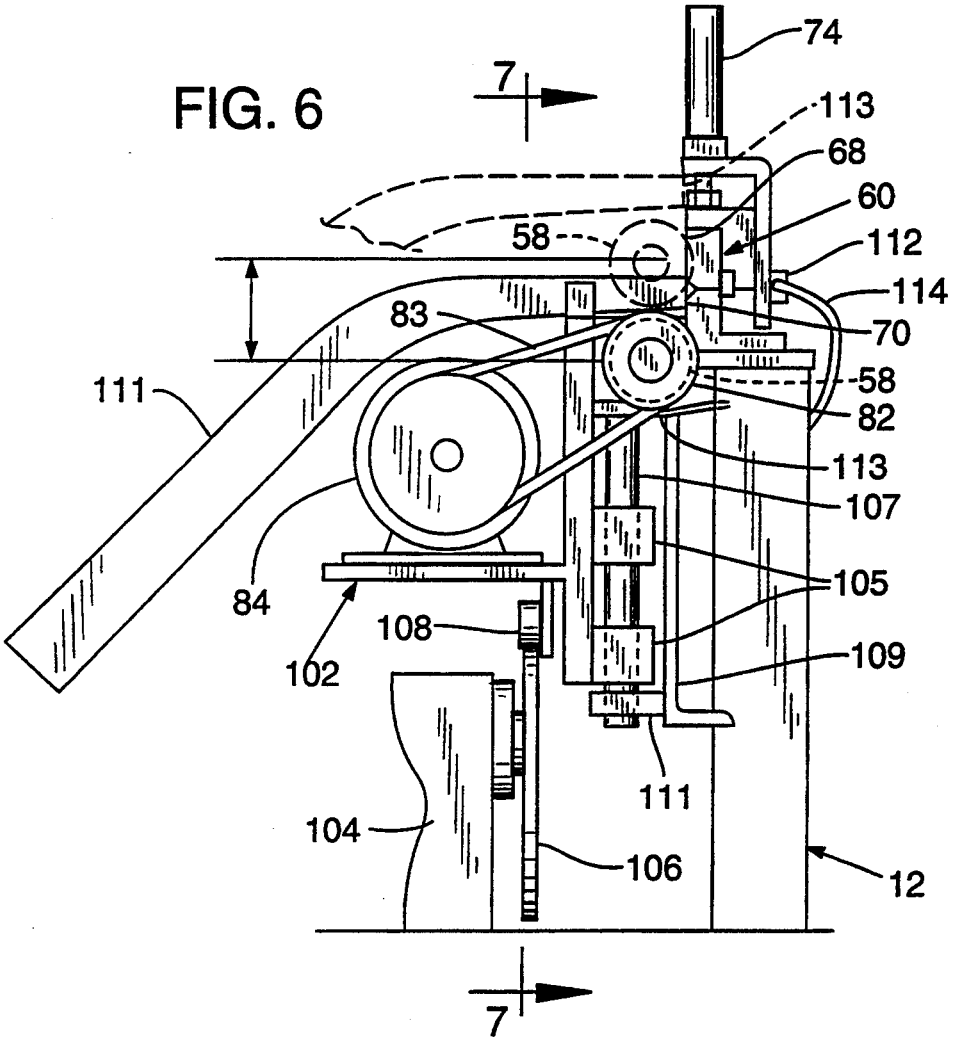
FIG. 6 is an elevational end view of the cutter portion of the FIG. 1 embodiment of the present invention.

The cutter 58 of the illustrated embodiment is shaped for rotation to generally trace out the surface of a cylinder with enlarged ends (see dashed lines 79 in FIG. 3C). The length of the cylinder depends upon the length of the cutter 58 and corresponds to the length of the desired wood patch. The cutter 58 may be a single unitary cutting element. However, the cutter 58 of the illustrated embodiment has two cutter bodies 78, 81 and a spacer 80 disposed on a spindle 76. The spindle 76 is an elongate rod having one end attached to a cutter pulley 82 that is driven, via a cutter belt 83, by a cutter motor 84 (FIG. 6). Bearings 86, 88 (FIG. 4) journal the spindle 76 to the carriage 102. Carriage 102 has flanges (not numbered) which support the bearings 86, 88 in place.

The middle portion 90 of the spindle 76 on which the cutter bodies 78, 81 and spacer 80 are disposed is of a reduced diameter (FIG. 3A). A key way 92 extends longitudinally along central portion 90 of the spindle. A corresponding longitudinal key way (see 93 in FIG. 3B) is provided in each cutter body and the spacer so that these elements may be keyed to the spindle 76 by a key (not shown) The spindle has an enlarged shoulder 94 which abuts the outer end of cutter body 81 when the cutter is assembled. A fastener, such as a nut on a threaded end 98 of spindle 76 holds the cutter assembly together.

The spacer 80, illustrated as a hollow cylinder with a key way along the interior wall, is positioned on the middle portion 90 of spindle 76 and between the cutter bodies.

The cutter bodies 78, 81, as best seen in FIGS. 3C or 4, each have a body section which is of the shape of a tapered or conical element. Plural, in this case three, cutting blades with cutting edges are disposed helically along the conical bodies 78, 79. Carbide cutting blades 100 with concave arcuate cutting edge profiles are brazed on these surfaces. The helical pattern and carbide material of the illustrated cutter blades 100 has been observed to yield cleanly cut wood patches.

In the illustrated embodiment, the arcuate blades 100 have radii of 2.125 inches. The conical bodies 78, 79 mirror one another when mounted to spindle 76 and are mounted such that the conical bodies flare out at the opposed ends of the cutter 58. The arcuate contours of cutting blade edges in combination with the cutter body sections create generally concave cutting surfaces.

The illustrated cutter 58 has a further advantage in that the spacer 80 is replaceable with spacers of differing lengths. Varying the length of the spacer changes, by an equal length, the length of the wood patch cut by the cutter 58. For example, the spindle nut may be removed to enable removal of both cutter bodies 78, 81 and the spacer 80. The removed spacer may be replaced with a spacer of a different length and/or the cutter bodies may be replaced with cutter elements of a different configuration.

The cutter motor 84, for example, may be a one-half horsepower, three phase, TEFC electric motor. Good patch cutting results with the illustrated embodiment when the cutter motor runs at 2800 rpm. It should be recognized, however, that different motors and different work speeds may be used.

This illustrated cutter construction is advantageous in that only a cylindrical spacer 80 of a different length is needed to change the length of the wood patch. A spacer of the appropriate length can be precisely and inexpensively obtained. Therefore, the illustrated embodiment incorporates an inexpensive wood patch length adjustment mechanism.

As described above, the helical blade pattern on the cutter bodies, along with the provision for a replaceable spacer 80, create an advantageous cutter 58. However, it should be understood that the cutter 58 may be varied.

For instance, the spacer 80 may be omitted with the cutter bodies 78, 81 abutting one another on the spindle 76. When rotating about the spindle 76, the blades of this alternative embodiment would trace out a cylinder with an arcuate concave longitudinal surface, yielding a patch with an arcuate surface and no middle portion of uniform cross-section. Another alternative embodiment would include cutter bodies of cylindrical, rather than conical, shape. The arcuate blades in this case would be angled to flare off toward one end of the cylinder. Such a cutter could be made to trace out the same shape as the cutter 58 of the illustrated embodiment.

Alternatively, the cutter may be of integral (one-piece) construction, without a spindle or spacer. The blades of such a cutter could be configured to trace out a desired surface (e.g. a cylinder with enlarged ends). A further alternative would be a cutter integrally constructed as a single cylindrical cutter body with blades extending along the entire length of the body. The blades again could be designed to project or flare outwardly to a greater extent at the ends of the cylinder, again tracing out a cylinder with enlarged ends when rotated. The blades could also be of a purely arcuate shape, tracing out an elongate with arcuate concave longitudinal surfaces.

It is further understood, moreover, that the cutter blades could extend axially, instead of helically, along the cutter body. Furthermore, the cutter blades could extend at any angle (other than perpendicular) to the axis of rotation of the cutter body. Numerous other variations will of course be apparent from this description.

In operation, for the cutter blades to cut a wood patch, the cutter 58 is passed transversely over the patch stock 22 held in the cutter clamp 60. As best shown in FIG. 6, this transverse movement is carried out by the cutter carriage 102, which supports both the cutter motor 84 and cutter 58. In the illustrated embodiment, the direction of the carriage movement is vertical.

The carriage 102 (FIG. 6) has four ball bearing containing blocks (two being shown in FIG. 6 and numbered as 105) which are arranged in sets of two with the blocks of each set being spaced apart and aligned vertically. In addition, the first and second sets of blocks are positioned on opposite sides of carriage 102. The sets of blocks 105 each slide on a respective vertical post, such as 107 in FIG. 6. The posts are each mounted to extend between flanges 111, 113 which project horizontally from a cross piece 109 of the frame 12. In the present embodiment, the bearing blocks are Thompson ball bearing blocks which move along stainless steel rods.

The cutter 58 is mounted on the carriage so that, as the carriage 102 moves on the rods 107, the cutter is moved in the vertical direction along a path which brings the cutter into contact with the wood patch stock 22 held in the cutter clamp 60. In the illustrated embodiment (see FIG. 6), this cutter path has an initial (upper) position above the wood patch stock. This initial position is shown in dashed lines as indicated by the dashed cutter 58 in FIG. 6. The cutter path has a second (bottom) position below the wood patch stock 22 as shown in solid lines in FIG. 6. Between these positions, the cutter 100 blades pass through the vertical grooves 72 (described in detail below) in the cutter clamp faces 68, 70.

Figure 7:
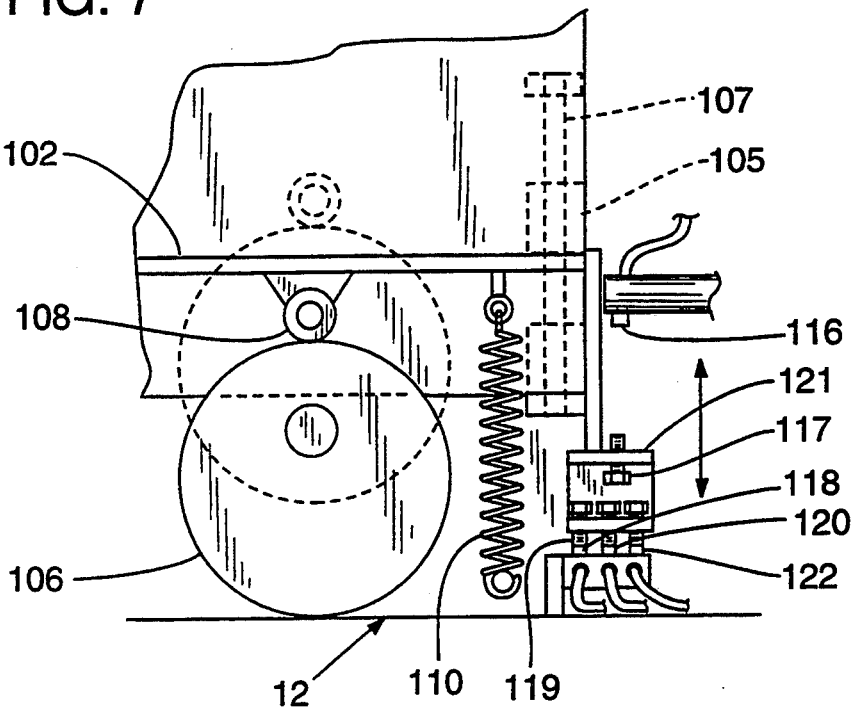
FIG. 7 is an elevational cutaway front view taken along line 7—7 of FIG. 6.

The movement of the carriage 102 is powered by a carriage motor 104 disposed below the cutter carriage. The carriage motor 104 rotates an attached cam 106 (see also FIG. 7). The cam 106 is circular, with a center of rotation which is offset from the geometrical center of the circle by one-half of the path length. A cam follower 108 attached to the lower surface of the cutter carriage 102 rides on the cam 106. A cam spring 110 (FIG. 7) interconnects the cutter carriage 102 and a base portion of the frame 12. The cam spring 110 is tensioned to urge the cam follower 108 against the cam 106 so that the movement of the carriage 102 precisely follows the vertical stroke of the cam.

A wood patch exit chute 111 is carried by the cutter carriage 102 and has a patch receiving opening 113 (FIG. 6) positioned above the cutter 58. The patch receiving opening 113 is positioned at the intersection of the faces 68, 70 of the cutter clamp 60 when the cutter 58 is at the bottom of the cutting stroke. A cut wood patch is blown into the exit chute opening 113 after cutting. The exit chute 111 directs the wood patches downwardly into a wood patch bin, or the like (not shown).

It should be understood that the exit chute 111 may be stationary. For instance, the chute and patch receiving opening may be positioned behind the clamp 60. In this embodiment, when the clamp 60 opens, a rearwardly directed blast of compressed air could be used to blow the cut patch rearwardly into the chute.

The carriage motor 104 rotates the cam 106 continuously to move the carriage continuously though successive vertical cycles. The carriage motor 104 of the present embodiment may be an explosion-resistant two horsepower, three-phase TEFC electric motor. Although variable, the carriage motor 104 is typically operated at sixty revolutions per minute, corresponding to a production rate of sixty wood patches cut per minute.

The cutter travels downwardly through a cutting stroke with the downward travel of the carriage. The apparatus is synchronized during initial start up (by adjusting the position of the cam 106) so that the sled 30 engages the second limit switch 34 (FIG. 2), which results in the cutter clamp 60 engaging the patch stock 22, as the cutter is moving downwardly from the initial position above the wood patch stock 22. The cutter blades 100 do not reach the patch stock 22 until the patch stock is gripped by the cutter clamp 60. The downward cutting stroke passes the rotating arcuate cutter blades 100 transversely across the wood patch stock with the ends of the cutter 58 cutting entirely through the patch stock held by the cutter clamp 60.

In the preferred embodiment, the cutter 58 is rotated in a direction which passes the arcuate blades 100 upwardly across the patch stock 22 as the cutter is moved downwardly by the carriage. Thus, the cutter blades cut the wood patch in a direction which is generally opposite to the linear direction of travel of the carriage 102. The carriage may also be moved upwardly through the cutting stroke, if desired. While it has been observed that this direction of rotation appears to produce a superior cut, wood patches can also be cut when the blades are rotated in the opposite direction.

Although preferred, the cutter 58 need not be rotated around an axis which is parallel to the wood patch stock elongate axis 23. For example, the cutter may be rotated about an axis which is not perpendicular to the axis 23. To make a wood patch of a given length with this cutter configuration, the lengths of the arcuate cutter blades 100 and spacer 80 necessarily increase as the angle between the cutter 58 rotation and the elongate axis 23 increases. Therefore, it is preferred that the cutter axis be at no more than an acute angle to, and most preferably parallel to, the axis 23.

Alternatively, instead of moving the cutter, the clamped patch stock may be moved across and relative to a stationary rotating cutter.

In the illustrated preferred embodiment, the faces 68, 70 of the cutter clamp 60 are contoured to expose the portions of the wood patch stock 22 which are to be cut. The clamp faces 68, 70 each have two vertical grooves 72 (FIG. 4) for the grooves in clamp portion 64 which intersect the longitudinal groove 66 (FIG. 5) and correspond to the contour followed by the rotating arcuate blades 100 as the cutter moves laterally across the clamp 60 during a cutting stroke. The vertical grooves 72 expose the portions of the patch stock 22 which are cut away to form a wood patch. With this approach, the portion of the wood patch stock between the cutting blades is clamped by clamp 60. That is, by clamping the wood patch stock between the two grooves 72, the wood patch stock does not vibrate or chatter during cutting, resulting in a clean cut. Of course, the cutter clamp 60 may be configured to clamp the patch stock 22 only between the two vertical grooves 72. While the quality of cut may decline, this alternative has an advantage in that the end of the wood patch stock need not be fed beyond the cutter into a clamp, with this clamped end being wasted as the patch is cut. Also, the clamp 60 may be configured to only clamp the stock 22 at a location outwardly from the path followed by the cutter 58. With such a clamp, the wood patch could automatically be dropped after cutting, possibly into an exit chute beneath the clamp.

In the present embodiment, the vertical clamp face grooves 72 may be produced by installing an ungrooved cutter clamp in the apparatus, and running the cutter through the cutting path. In the preferred embodiment, the cutter clamp is made of a phenolic plastic which is cutable by the cutters to form the grooves 72. Cutter clamps of other materials may also be used.

The cutability of the cutter clamp has another advantage in that the vertical face grooves 72 are automatically recut if the cutting clamp position is adjusted to move the clamp 60 toward the cutter 58. The channel block 40 on which the cutter clamp 60 is mounted permits this adjustment. Two bolts (not shown) extend through lateral slots 77 in the channel block 40 to secure the channel block 40 to the frame top 14. The bolts can be loosened to adjust the channel block position relative to the cutter 58. If adjusted toward the carriage and cutter, the cutter 58 may be moved through a cutting stroke, cutting new vertical grooves 72 in the clamp portions 62, 64.

A wood patch production cycle utilizing the illustrated embodiment of the present invention will now be described. The wood patch stock 22 is advanced along the longitudinal 23 axis through the cutter clamp 60. When the cutter 58 passes through the initial position at the top of the cutting stroke, a first screw 117 (see FIG. 7) extending from a clamp on the side of the carriage 102 engages a first limit switch 116. The first limit produces a signal which causes the feed clamp 26 to be operated to engage the wood patch stock and also causes the sled 30 to transport the patch stock elongate toward the cutter 58. Adjacent the carriage 102, the sled 30 engages the second limit switch 34 which causes the cutter clamp 60 to be operated to engage the wood patch stock before the cutter 58 reaches the wood patch 22 during the cutting stroke.

After cutting the wood patch, the carriage 102 and the cutter 58 reach the bottom of the cutting stroke. At the bottom position, screws 119 attached to a bracket 121 extending from the cutter carriage simultaneously engage third, fourth, and fifth limit switches 118, 120, 122.

The third limit switch 118 produces a signal which activates a valve which causes the cutter clamp 60 to release the wood patch. The fourth limit switch 120 produces a signal which activates a valve in an air manifold 112 (see FIGS. 2 and 4) to eject pressurized air onto the patch, thereby urging the patch into the exit chute 111. The air manifold is mounted on the rear face of the channel block 40, and is supplied with pressurized air by an air hose 114 which connects the air manifold to a compressor. When the air manifold valve is opened, a passage within the manifold guides the pressurized air into six channel block air holes (not shown) which are spaced along the intersection of the upper and lower clamp portions 62, 64. In this way, the pressurized air uniformly strikes the wood patch to push it into the exit chute 111.

The fifth limit switch produces a signal which causes the feed clamp 26 to open and the return of the sled 30 to the home position. The cutter carriage 102 then returns the cutter 58 to the initial position at the top of the cutting path to again engage the first limit switch 116 and repeat the wood patch cutting cycle. The carriage motor 104 operates independently of any of the limit switches, cycling the cutter assembly continuously through successive cutting strokes. While the illustrated embodiment preferably relies on limit switches for control purposes, it should be apparent that other position sensing devices are also suitable, including optical, ultrasonic, magnetic, or proximity sensing devices. In addition, instead of proximity sensing devices, timing mechanisms may be used for control purposes. In addition, the apparatus may be computer controlled, if desired.

This detailed description is set forth only for purposes of illustrating examples of the present invention and should not be considered to limit the scope of the invention in any way. Clearly, numerous additions, substitutions, and modifications can be made to these examples without departing from the scope of the invention, which is defined by the appended claims and their equivalents.

I claim:

1. An apparatus for forming wood patches from elongated wood patch stock, the wood patch stock having a longitudinal axis, the apparatus comprising:

means for advancing the wood patch stock longitudinally;

a cutter;

means for rotating the cutter about a cutting axis which is not perpendicular to the longitudinal axis of the wood patch;

the cutter having plural cutting edges which generally trace out the surface of a cylinder with enlarged ends as the cutter is rotated about the cutting axis;

means for moving the cutter and wood patch stock transversely relative to one another with the cutter in contact with the wood patch stock to cut a patch from the wood patch stock.

2. An apparatus for forming wood patches from elongated wood patch stock, the wood patch stock having a longitudinal axis, the apparatus comprising:

a frame;

a carriage mounted to the frame for movement in one direction;

means for moving the carriage in said one direction;

a cutter mounted to the carriage and movable with the carriage in said one direction along a path;

means for rotating the cutter about a cutter axis at least during a portion of the movement of the carriage in said one direction such that as the carriage is moved in said one direction relative to the wood patch stock, the rotating cutter is moved along the path and into contact with the wood patch stock to cut a wood patch from the wood patch stock.

3. An apparatus according to claim 2 including a wood patch stock feeder mounted to the frame and operable to advance the wood stock longitudinally into the path along which the cutter is moved with the carriage.

4. An apparatus according to claim 3 in which said one direction is perpendicular to the longitudinal axis of the wood patch stock and in which the cutter axis is parallel to the longitudinal axis.

5. An apparatus according to claim 3 in which the wood patch stock has an asymmetric cross section, the feeder including a wood patch stock guide operable to orient the wood patch stock about its longitudinal axis and relative to the cutter.

6. An apparatus according to claim 3 in which the wood patch stock has an asymmetrical cross section, the feeder including a wood patch ingress guide with a guide opening shaped to correspond to the cross sectional dimension of the wood patch stock, the wood patch stock being fed through the guide opening and oriented by the ingress guide for cutting by the cutter.

7. An apparatus according to claim 3 in which the feeder further comprises:

a feed clamp with a home position, said feed clamp clamping onto the inserted patch stock at the home position, the feeder carrying the wood patch stock clamped by the feed clamp from the home position and longitudinally to a second position adjacent to the cutter;

a cutter clamp positioned adjacent to the cutter for receiving the wood patch stock and being operable to clamp the wood patch stock to immobilize the wood patch stock with the wood patch stock positioned in the path for cutting by the cutter.

8. An apparatus according to claim 7 in which the feeder includes a channel having a channel wall, the channel being disposed between the second position and the cutter clamp, the channel having a flared access opening through which the wood patch stock is longitudinally fed; and feed rollers supported by the channel for resilient engagement with the channel wall, the feeder longitudinally advancing the wood patch stock between the rollers and the channel wall, said rollers providing a biasing force against the wood patch stock.

9. An apparatus according to claim 3 in which the cutter further comprises:

a spindle;

first and second cutter body sections carried by the spindle, a spacer separating the first and second cutter body sections, said cutter body sections each being conical with a first end of an enlarged diameter and a second end of a diameter which is smaller than the diameter of the first end, the body sections being oriented axially on the spindle with the respective second ends separated from one another by the spacer, plural helical cutting blades mounted to each body section, each cutting blade having a cutting edge with a concave arcuate profile; and the cutter axis corresponding to the axis of the spindle, the carriage moving the cutter from an initial position and through a cutting stroke in which the arcuate cutting edges of the cutter blades are moved transversely across the wood patch stock and cut through the wood patch stock as the wood patch stock is held by the cutter clamp to yield a wood patch, the wood patch having an uncut middle segment having a length corresponding to the length of the spacer, and end segments which each taper in an arcuate surface with a radius which is equal to the radius of the arcuate cutting edges.

10. An apparatus according to claim 9 in which the cutter further comprises a fastener for securing the cutter body sections and the spacer to the spindle, said fastener being removable to allow for the substitution of a spacer of a different length, and cutter body sections with cutter blades with cutting edges of different arcuate profiles, thereby permitting a variation in the length and the arcuate surface of the wood patch which is cut by the cutter.

11. An apparatus for forming wood patches according to claim 9 further comprising:

a first limit switch positioned for engagement by the carriage when the carriage is in the initial position for causing the activation of the feed clamp to clamp the wood patch stock and the feeder to convey the wood patch stock longitudinally to the second position;

a second limit switch positioned for engagement by the feeder upon movement of the wood patch stock to the second position for causing the activation of the cutter clamp to clamp the wood patch stock;

a third limit switch positioned for engagement by the carriage assembly at the end of the cutting stroke for causing the deactivation of the cutter clamp to release the wood patch stock at the end of a cutting stroke;

a source of pressurized air with a valve and air delivery opening;

a wood patch exit chute coupled to the frame and having a patch receiving opening adjacent to the air delivery opening;

a fourth limit switch positioned for engagement by the carriage at the end of the cutting stroke for causing the activation of the valve to release pressurized air to the air delivery opening to carry the wood patch into the exit chute; and a fifth limit switch positioned for engagement the carriage at the end of the cutting stroke, said fifth limit switch for causing the deactivation of the feed clamp such that the feed clamp releases the wood patch stock in preparation for the engagement of the first limit switch and a subsequent patch cutting cycle.

12. An apparatus according to claim 11 in which the exit chute is mounted to the carriage for movement therewith.

13. An apparatus according to claim 3 including a patch exit chute coupled to the frame and having a patch receiving opening and an air delivery opening directed toward the patch receiving opening for directing premixed air into the patch receiving opening to carry cut wood patches into the chute.

14. An apparatus for forming wood patches according to claim 13 wherein the exit chute comprises a downwardly directed chute mounted to the carriage for movement with the carriage during the cutting stroke.

15. An apparatus according to claim 7 in which the cutter clamp is operable to clamp the wood patch stock at least at both sides of the path followed by the cutter during a cutting stroke.

16. An apparatus according to claim 15 wherein the cutter clamp has a face which is positioned adjacent to the path followed by the cutter, the cutter clamp face having a contour which is complementary to the profile of the rotating cutter to allow the cutter to pass along the cutter clamp face and cut a patch from the wood patch patch stock held in the cutter clamp.

17. An apparatus for forming wood patches according to claim 16 wherein the cutter clamp face is made of a plastic material, the contour of the cutter clamp face being cut by passing the rotating cutter along the path and across an uncontoured cutter clamp face during a cutting stroke.

18. An apparatus for forming wood patches according to claim 7 in which the feeder includes a sled which is slidably mounted to the frame, the feed clamp being mounted to the sled, the feeder including a track extending between the home position and the second position for receiving the sled and guiding the sliding motion of the sled.

19. An apparatus for forming wood patches according to claim 7 including pneumatic actuators coupled to the feed clamp and the cutter clamp for operating each of said clamps.

20. An apparatus for forming wood patches according to claim 15 from wood patch stock on a right triangular cross-section with a hypotenuse, the feeder orienting the wood patch stock for clamping by the cutter clamp with the hypotenuse of the triangle positioned toward the cutter path and tilted or offset from vertical face cutting by the cutter during a cutting stroke.

21. A method of forming wood patches from elongated wood patch stock, the wood patch stock having a longitudinal axis, the method comprising:

moving the elongated wood patch stock longitudinally in a first direction;

rotating a patch cutting blade about an axis that is not perpendicular to the longitudinal axis;

moving the rotating patch cutting blade and the elongated wood patch stock relative to one another so as to transversely move the rotating patch cutting blade across the elongated wood patch stock to cut a patch from the wood patch stock.

22. A method according to claim 21 in which the step of moving the elongated wood patch stock comprises the step of incrementally advancing the wood patch stock in the first direction prior to the cutting of a patch.

23. A method according to claim 22 in which the step of incrementally advancing the wood patch stock comprises the step of fluidically advancing the wood patch stock.

24. A method according to claim 23 including the step of clamping the wood patch stock prior to incrementally advancing the wood patch stock.

25. A method according to claim 21 including the step of ejecting a patch following cutting of the patch.

26. A method according to claim 21 wherein the patch cutting blade is rotated about an axis that is at an acute angle with respect to the longitudinal axis.

27. A method according to claim 21 wherein the cutting blade is rotated about an axis which is parallel to the longitudinal axis.

28. An apparatus for forming wood patches from elongated wood patch stock, the wood patch stock having a longitudinal axis, the apparatus comprising:

a cutter;

means for rotating the cutter about a cutting axis which is not perpendicular to the longitudinal axis of the wood patch stock;

a frame;

a carriage mounted to the frame;

means for moving the carriage in one direction perpendicular to the longitudinal axis of the wood patch stock and in which the cutter axis is parallel to the longitudinal axis;

the cutter mounted to the carriage and movable with the carriage in said one direction along a path, the cutter having plural cutting edges which generally trace out the surface of a cylinder with enlarged ends as the cutter is rotated about the cutting axis;

means for moving the cutter and wood patch stock transversely relative to one another with the cutter in contact with the wood patch stock to cut a patch from the wood patch stock;

means for rotating the cutter about the cutter axis at least during a portion of the movement of the carriage in said one direction such that as the carriage is moved in said one direction relative to the wood patch stock, the rotating cutter is moved along the path and into contact with the wood patch stock to cut a wood patch from the wood patch stock;

a feeder mounted to the frame and operable to advance the wood stock longitudinally into the path along which the cutter is moved with the carriage;

the wood patch stock having an asymmetrical cross section, the feeder including a wood patch ingress guide with a guide opening shaped to correspond to the cross sectional dimension of the wood patch stock, the wood patch stock being fed through the guide opening and oriented by the ingress guide for cutting by the cutter;

a feed clamp with a home position, said feed clamp clamping onto the inserted patch stock at the home position, the feeder carrying the wood patch stock clamped by the feed clamp from the home position and longitudinally to a second position adjacent to the cutter;

a cutter clamp positioned adjacent to the cutter for receiving the wood patch stock and being operable to clamp the wood patch stock to immobilize the wood patch stock with the wood patch stock positioned in the path for cutting by the cutter;

the feeder including a channel having a channel wall, the channel being disposed between the second position and the cutter clamp, the channel having a flared access opening through which the wood patch stock is longitudinally fed;

feed rollers supported by the channel for resilient engagement with the channel wall, the feeder longitudinally advancing the wood patch stock between the rollers and the channel wall, said rollers providing a biasing force against the wood patch stock;

a spindle;

first and second cutter body sections carried by the spindle, a spacer separating the first and second cutter body sections, said cutter body sections each being conical with a first end of an enlarged diameter and a second end of a diameter which is smaller than the diameter of the first end, the body sections being oriented axially on the spindle with the respective second ends separated from one another by the spacer, plural helical cutting blades mounted to each body section, each cutting blade having a cutting edge with a concave arcuate profile;

the cutter axis corresponding to the axis of the spindle, the carriage moving the cutter from an initial position and through a cutting stroke in which the arcuate cutting edges of the cutter blades are moved transversely across the wood patch stock and cut through the wood patch stock as the wood patch stock is held by the cutter clamp to yield a wood patch, the wood patch having an uncut middle segment having a length corresponding to the length of the spacer, and end segments which each taper in an arcuate surface with a radius which is equal to the radius of the arcuate cutting edges;

the cutter further comprising a fastener for securing the cutter body sections and the spacer to the spindle, said fastener being removable to allow for the substitution of a spacer of a different length, and cutter body sections with cutter blades with cutting edges of different arcuate profiles, thereby permitting a variation in the length and the arcuate surface of the wood patch which is cut by the cutter;

an exit chute comprising a downwardly directed chute mounted to the carriage for movement with the carriage during the cutting stroke.

29. An apparatus according to claim 28, further comprising:

a first limit switch positioned for engagement by the carriage when the carriage is in the initial position for causing the activation of the feed clamp to clamp the wood patch stock and the feeder to convey the wood patch stock longitudinally to the second position;

a second limit switch positioned for engagement by the feeder upon movement of the wood patch stock to the second position for causing the activation of the cutter clamp to clamp the wood patch stock;

a third limit switch positioned for engagement by the carriage assembly at the end of the cutting stroke for causing the deactivation of the cutter clamp to release the wood patch stock at the end of a cutting stroke;

a source of pressurized air with a valve and air delivery opening;

the exit chute coupled to the frame and having a patch receiving opening adjacent to the air delivery opening;

a fourth limit switch positioned for engagement by the carriage at the end of the cutting stroke for causing the activation of the valve to release pressurized air to the air delivery opening to carry the wood patch into the exit chute; and a fifth limit switch positioned for engagement the carriage at the end of the cutting stroke, said fifth limit switch for causing the deactivation of the feed clamp such that the feed clamp releases the wood patch stock in preparation for the engagement of the first limit switch and a subsequent patch cutting cycle.

* * * * *